United States Patent [19]

Daniels

[11] Patent Number: 4,793,170

[45] Date of Patent: Dec. 27, 1988

[54] SHEAR BLADE FOR ALUMINUM EXTRUSION PROCESS

[76] Inventor: Everett Daniels, Rte. 7, Box 380, Westwood Estates, Piedmont, S.C. 29673

[21] Appl. No.: 64,119

[22] Filed: Jun. 19, 1987

[51] Int. Cl.[4] ..... B21C 35/04

[52] U.S. Cl. ..... 72/255

[58] Field of Search ..... 72/253.1, 254, 255, 72/273.5; 83/440

[56] References Cited

U.S. PATENT DOCUMENTS

| | | | |
|---|---|---|---|
| 195,645 | 9/1877 | Powell . | |
| 1,792,522 | 2/1931 | Yates . | |
| 1,826,016 | 10/1931 | Naylor et al. . | |
| 2,620,030 | 12/1952 | Anderson . | |
| 2,735,179 | 2/1956 | Stanton . | |
| 2,893,551 | 7/1959 | Pirwitz | 72/253.1 |
| 2,896,782 | 7/1959 | Billen . | |
| 3,028,006 | 4/1962 | Petsch et al. . | |
| 3,175,384 | 3/1965 | Groos et al. . | |
| 3,270,606 | 9/1966 | Schott, Jr. . | |
| 3,348,441 | 10/1967 | Toney et al. . | |
| 3,362,272 | 1/1968 | Grosse . | |
| 3,422,711 | 1/1969 | Toney et al. . | |
| 3,780,606 | 12/1973 | Jentsch, Jr. et al. . | |
| 3,798,953 | 3/1974 | Sgambati et al. . | |
| 3,913,420 | 10/1975 | Coon . | |
| 4,052,877 | 10/1977 | Zilges et al. | 72/255 |
| 4,063,483 | 12/1977 | Kawaguchi et al. . | |
| 4,165,625 | 8/1979 | Wagner et al. . | |
| 4,317,352 | 3/1982 | Doudet . | |
| 4,475,372 | 10/1984 | Ostlinning et al. . | |
| 4,526,073 | 7/1985 | Elhaus . | |
| 4,570,473 | 2/1986 | Huertgen . | |

FOREIGN PATENT DOCUMENTS

| | | | |
|---|---|---|---|
| 289364 | 1/1967 | Australia . | |
| 2237276 | 2/1973 | Fed. Rep. of Germany | 72/273.5 |

*Primary Examiner*—Lowell A. Larson

[57] ABSTRACT

An improved method of severing butt ends of aluminum billets using an improved blade design which peels the butt end from the billet. Die ring alignment prongs position the blade to leave a predetermined amount of metal on the die face and protect the blade from inadvertent contact with the die and die ring. The improved blade is provided with a cutting edge and angular wedge shape to facilitate peeling of the butt end from the billet.

21 Claims, 2 Drawing Sheets

FIG. 1
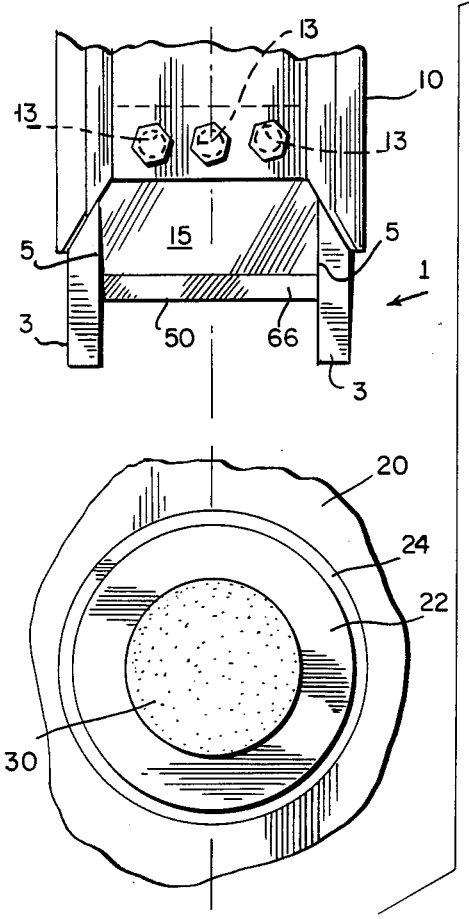
FIG. 2
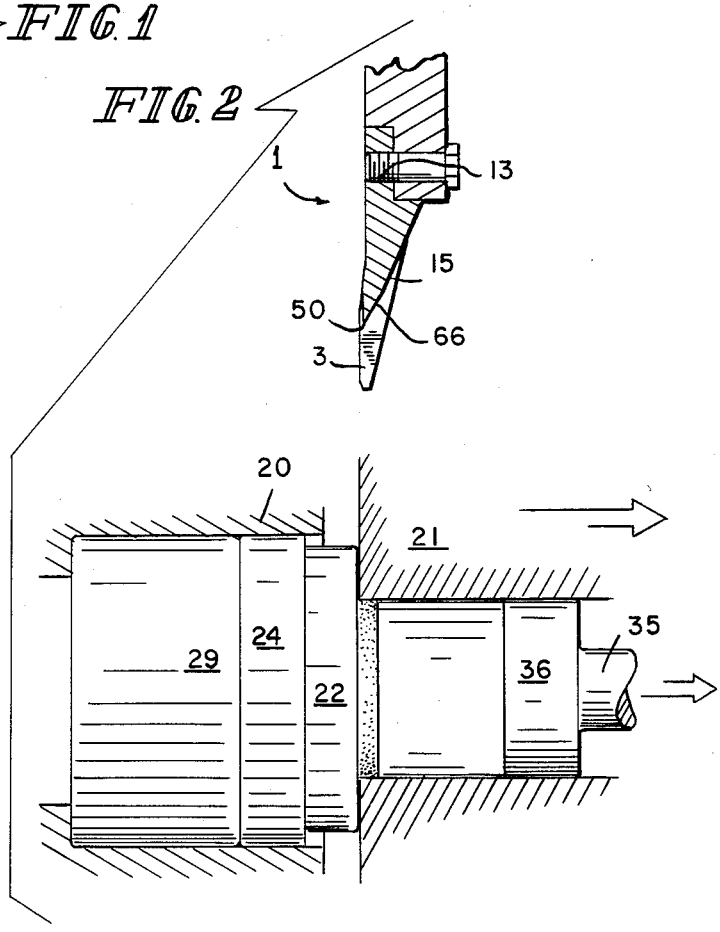
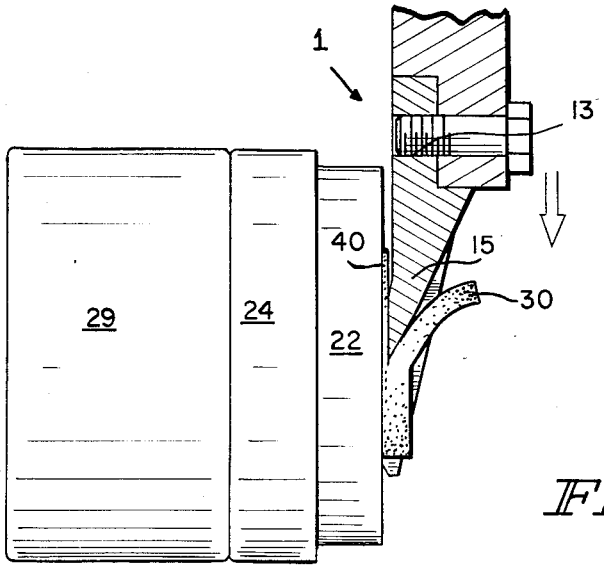
FIG. 3

SHEAR BLADE FOR ALUMINUM EXTRUSION PROCESS

BACKGROUND AND SUMMARY OF THE INVENTION

In the extrusion of metals, particularly aluminum, the process starts with a metallic log. These logs come in various diameters depending on the size of the extrusion press. A log is loaded into an oven and in the aluminum industry, heated to a temperature of between 800 and 900 degrees. The log then goes from the oven into a log shear and is cut to predetermined length depending on the type and length of extrusion to be manufactured.

The sized logs, called billets, are then transferred by a conveyor to a charger for an extrusion press which, in turn, loads the billet onto a billet loader. Next, the billet loader places the heated billet into a cylinder, which is referred to as the container. The container is moved to a position where the container seals against a die ring at the face of the extrusion press. A hydraulic ram pushes the heated billet through the container.

The ram saves the billet through the container into the die ring which holds a die for the specific shape of the extruded product. The process of pushing the aluminum through the container and die is called extruding. Depending on the shape of the die, various items can be extruded from the hot aluminum billet.

The oxides and other impurities in the aluminum are typically on the radial surface of the billet. These impurities and oxides end up in the butt end of the billet. If the butt end of the billet were not removed from the billet prior to loading another billet, the impurities and oxides would find their way into the extrusion. Therefore, it is necessary to remove the butt end before the next billet is loaded into the container and the extrusion press.

The butt shearing step takes place after the ram has pushed the billet substantially through the die. The ram then goes back out of position and the container is withdrawn. The butt shear comes down and shears off the butt end which includes all of the oxides, scales and other impurities. The butt end of the billet is then transferred to a scrap bin. Some butt shears require a separate step to remove the butts which can stick to the blade.

During the extrusion process, a run out table is used to support the hot extruded product. However, some extruding operations use a puller connecting directly to the extruded forms which pull the extrusion out onto a table. One advantage of using a puller is that it groups and keeps the sections from running together. Another advantage is that the extrusion can be run out faster. After the extrusion has been pulled out to its entire length, an extrusion shear or an operator using a torch may cut the extrusion prior to starting a new extrusion.

After the item is out on the extrusion table, it is then cooled to approximately room temperature and then stretched to remove kinks or other deficiencies. This stretching is typically one percent of the length.

In the extrusion process, dies may either be hollow or solid. In order to extrude a hollow webbed member, such as a tube, the die typically has a cap and a mandrel and the heated aluminum will flow around the webs of the mandrel and through the die to create a hollow shape. These dies can also be called feeder dies. The cap holds or supports an inner section to allow hollow shapes to be formed.

Extrusion dies of either the hollow or solid type typically have different size openings and the hot aluminum can go through larger openings faster than smaller openings. In order to compensate for this problem, the dies have varying length bearing surfaces. A bearing surface is a tapered entrance in which the aluminum flows as it moves through the die. The longer the bearing, the slower the feed. Therefore, when simultaneously extruding large and small shapes, the bearing surfaces need to be adjusted so that the extruded items runs out onto the table uniformly.

The pressure of the ram against these dies require the dies to be adequately supported and held together. A backer and bolster are included with the die arrangement to support and add mass to the die. The die ring holds the die, backer and bolster together in the proper relative position.

The numerous problems associated with the use of prior art shear blade designs are described below:

1. The known shear blades have typically had a cutting edge angle of approximately 15 degrees on the bottom side which comes down in contact with the butt. The top of the butt is smashed down as the blade pushes the butt downward across the face of the die in a tearing action. The thickness of the butt has to be sufficient to resist the severe deformation during this cycle. These butts are typically one inch to one and one-half inch depending on the type of die. This smashing of the butt is a larger problem with hollow dies. The hollow shape is deformed onto the die face causing sealing problems when the container is moved forward for the next push. When extruding small solid shapes, the relatively small contact areas between the spent billet and the butt enables the shearing device to shear off the butt directly at the die face, therefore, the typical problems with deformation are not as apparent.

2. As the butt is being sheared at the face of the die, aluminum is pulled from the ports of both hollow and feeder plate dies which leave voids to entrap air when the next billet is pressed against the die. A burp cycle is used to try to displace the air, but air blisters still appear on a large portion of extrusions using the above dies. A burp cycle is performed by backing the container away from the press after initially sealing the container to the press to let air out and then the container reseals against the press.

3. Extensive aluminum build-up on the face of die, die ring, and container face is caused by the tendency of the butt shear blade to be forced away from the die during the shearing operation. Additionally, prior art shear blades tend to tear the butt off rather than clearly shearing the butt off. Thus, the aluminum left on the die face is rough and uneven. When the container, holding another billet comes into contact with the aluminum left on the die face, air voids are created between the billets. These air voids cause blisters in the extruded products.

4. The uneven sealing surface, caused by the partly displaced aluminum, can cause the container to cock in various planes as it attempts to seal against the die face. This creates havoc when using a fixed dummy block fastened to the die end of the ram. Many fixed dummy blocks have been broken or mutilated as it starts to enter the container when the container is not in alignment. The dummy block is the connection between the ram and the billet.

5. In the use of prior art, butt shear blades often causes the butt to remain stuck to the die face or to the shear blade. A visual inspection after the shearing operation is required to make sure the butt is cleared for the container to seal. If not inspected, and the container attempts to seal on a butt, the container cylinder rods may be bent, inflicting great damage to the press and a consequent loss of production time and the incurrence of large expenses for repairs. Auxiliary devices to knock off butts, and where applicable, sensitive pressures switches, have been utilized on some presses to attempt to minimize the damage, but these solutions are expensive and unreliable. The uncertainty over whether the butt has been cleared from the die or butt shear blade has prevented the use of an automatic cycle on extrusion presses thereby increasing the need for labor and the cycle time, with the result of lost profits.

An object of the present invention is therefore to provide a new and improved butt shear blade design, which overcomes these and other problems.

It is a further object of the present invention to provide a virtually "stick-free" blade for peeling or cleanly shearing butts from spent billets.

It is a further object of the present invention to provide die ring alignment prongs attached to a shear blade which position the die ring and the die prior to the butt shearing operation.

It is a further object of the present invention to mount said blade so that 3/32"–⅛" if material is left on the die face thereby allowing the blade to cut through the aluminum present on both sides of the cutting edges, thereby leaving a smooth aluminum face on the die and eliminating air cavities on the face of the die.

It is a further object of the present invention to eliminate the burp cycle in an automated extrusion operation.

It is a further object of the present invention to reduce scrap aluminum by allowing a reduced thickness of butt to be sliced from a billet.

It is a further object of the present invention to provide automatic shearing of the butt without the need of an operator.

It is a further object of the present invention to eliminate costly down time and bending of container cylinder rods.

It is a further object of the present invention to provide a butt shearing device which greatly reduces the need to clean the die and container surface.

These and other objects of the present invention are attained by the provision of an improved shear blade to slice or peel the butt end of the billet from the die face in an extrusion operation. In a preferred embodiment of the present invention the cutting edge of the shear blade is provided with a 35 degree wedge angle between the die side of the blade and the container side of the blade. This angle allows minimum resistance while cutting and causes peeling or clean shearing as the sheared butt peels or curves away from the blade. This angle also tends to keep the butt shear blade from moving away from the die during the shearing operation.

In a preferred embodiment, the blade has a maximum vertical length of 1 inch for the front and rear cutting surfaces. This dimension tends to reduce the area of contact and friction during the cutting.

The improved shear blade of the preferred embodiment includes a supplementary relief angle on the container side of the blade which is less than the cutting edge angle. This arrangement ensures that the sheared portion of the butt is not in contact with the blade.

The shear blade of the preferred embodiment includes alignment prongs to keep the cutting ring and die edge from coming into contact with the die. The projection of the prongs below the cutting edge keeps the blade from hitting the die ring and die as well as allowing for a predetermined thickness of remainder of billet to be left on the die face.

Other objects, advantages and novel features of the present invention will become apparent from the following detailed description of the invention when considered in conjunction with the accompanying drawings.

BRIEF DESCRIPTION OF THE DRAWINGS

FIG. 1 is a front view of the shear blade and alignment prongs attached to a guide means prior to the shearing operation of the shear blade.

FIG. 2 is a side view of the shear blade with portions broken away in a position prior to the shearing operation.

FIG. 3 is a side view of the shear blade with portions broken away in position approximately half way through the shearing.

DETAILED DESCRIPTION OF THE DRAWINGS

Figure 4:
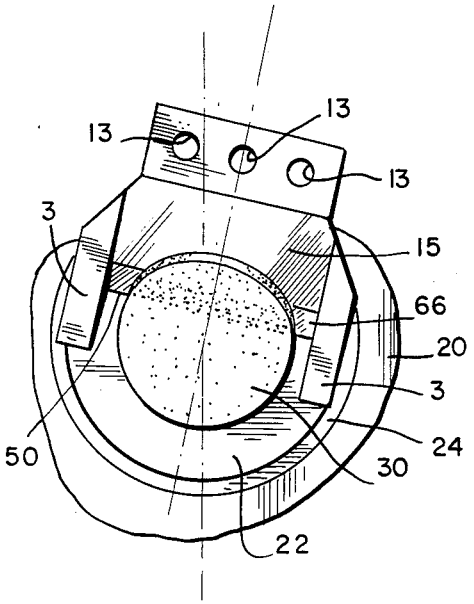
FIG. 4 is a front view of the shear blade showing the engagement of the prongs on the die ring during the operation of the shear.

FIG. 1 shows the improved blade design 1 in a position prior to the initiation of the shearing of the butt end 30 of the billet. The shear blade 1 is shown with two alignment prongs 3 connected to the edges 5 of the shear blades. The blade has three bores 13 to connect the blade 1 to a standard operative force device (not shown) for the shearing operation. Any type of connection means to hold the blade to the operative force device can be used. As shown in FIGS. 1 and 2 the blade is guided by a blade guiding bracket 10. Typically, the operative force device connected to the blade 1 is a hydraulic ram device associated with guide means 10 to allow the shear to operate in a direction substantially perpendicular to the longitudinal axis of the billet. The drawing is a section of part of an extrusion press which is used to extrude aluminum sections.

The container face 20 surrounds the die face 22, the die ring 24, and the billet 30. The container face and the die ring provides a sealing surface for the container 21 as the new billet is positioned against the remaining aluminum left on the die face after the butt shearing operation.

The operation of the shear takes place after a ram 35 having a fixed dummy block 36 has pushed a heated billet through the container 21. As the billet is pushed through the container 21, it goes through the die face 22 and is extruded into the shape formed by the die. The ram 35 and dummy block 36 are then withdrawn from the container, the container is moved away from the container face and the shear is moved downward to slice off the butt. The ram is connected to a pressure device, typically a hydraulic cylinder, which is not shown in the drawing. When using the new design for the shear blade, the ram is set to leave a ½ to ⅝ inch butt to be sliced from the spent billet. The cooperation of the alignment prongs 3 and the blade approximately ⅛ inch of aluminum 40 remains on the die face after the butt is sheared. The alignment prongs 3 position the blade 15 so as to leave this desired amount of residual aluminum. Therefore, the blade 15 cuts through the aluminum surface on both sides rather than breaking the butt off at the die face. The shear blade 10 is then retracted up out of the way, the container 21 is into position against die ring 24, another billet is loaded into the container, the ram 35 is activated and begins to push the new billet against the end of the spent billet. The smooth surface from the cut using the butt shear blade of the present invention allows the new billet to seal effectively without air pockets forming between the surfaces.

The peeling effect achieved by the shear blade of the present invention is shown in FIG. 3. The blade is shown approximately half way through a butt end of a billet. The butt 30 is shown peeling away from the die ring. A bolster 29 is shown reinforcing the die and die ring. The peeling allows less contact between the blade and the butt and reduces the chance that the butt will stick to the blade or die face. The cutting action requires less force than smashing a butt from the die face and also provides a smoother surface. The residual aluminum 40 is shown remaining on the surface of the die. Periodic lubrication and polishing of the blade help to eliminate sticking of the butt to the blade and assure a clean shearing of the butt.

The aluminum left on the face of the die ring has a relatively smooth surface. This smooth surface provides a good seal when the next billet is loaded into the extrusion press. The shear blades of the prior art leave ragged and uneven surfaces on the die ring and the spent billet, causing uneven loading of the next billet or a cocking of the container. These problems requires extrusion machines to run a burp cycle to allow air trapped between the old and new billet to be released prior to extrusion.

The use of the shear blade of the preferred embodiment of the present invention allows a thin section of aluminum 30 to be removed from the butt end of the billet. (Typically between $\frac{1}{2}''$–$\frac{5}{8}''$ in length). The prior art shear blades required a larger butt to be removed so as to allow the shear to smash or break the butt from the billet. This was usually a $1\frac{1}{4}''$–$1\frac{1}{2}''$ length butt. The improved blade design of the present invention allows for reduced scrap material resulting in savings.

Figure 5:
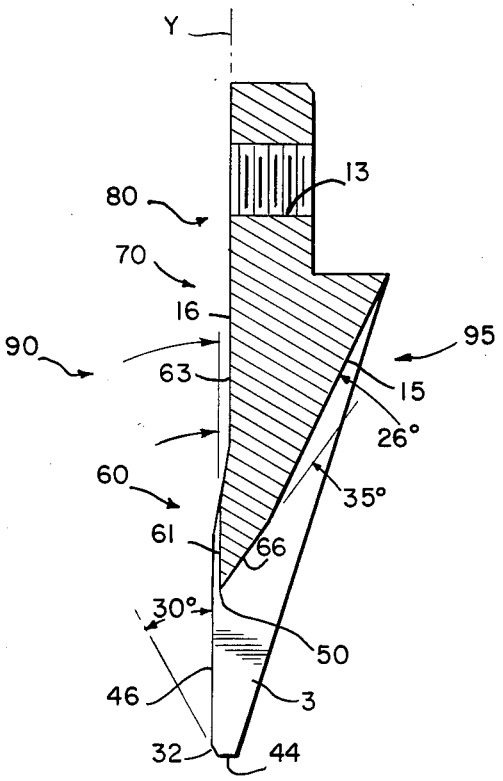
FIG. 5 is an enlarged side view of the the shear blade.

As best depicted in FIGS. 4 and 5, as the blade is forced in a direction towards the billet, the alignment prongs 3 have a cam surface 32 which is used to insure that the blade will not inadvertently come in contact with the die face 22 or die ring 24. The cam surface 32 is used to force a die or die ring which has become worn back into its proper operative position. FIGS. 4 and 5 further illustrate the shape of the die ring alignment prongs 3 and the blade 15. The alignment prongs 3 have a cam surface 32 for pushing the die ring back into its proper position. Specifically, the alignment prongs 3 have a substantially vertical face 46 which slides against the die ring and is displaced approximately $\frac{1}{8}$ inch from the substantially vertical side of the shear blade. The cam surface 32 connects the flat bottom surface 44 to the vertical face 46 of the alignment prong.

The cam surface, in a preferred embodiment, is 30 degrees from the vertical axis Y as seen in FIG. 5 to facilitate positioning of the blade in relation to the die ring. FIG. 4 illustrates that the shear can operate at any angle relative to the Y axis as long as the cut is made resulting in smooth surfaces for the billets. The figure depicts a 12 degree angle from vertical for the shear. This allows for the butt to peel off in a direction towards the shear bin.

The alignment prongs 3 are attached to the blade at the edges of the blade so that the prongs do not interfere with the shearing of the butt end of the billet. As illustrated in FIGS. 1 and 4, the lowermost portion of the alignment prongs 3 is positioned below the cutting edge of the shear blade so as to ensure that the prongs 3 engage the die ring prior to the blade reaching a plane even with the top of the die ring. The space between each of the alignment prongs 3 allows for some lateral movement of the die ring in the event the die ring is worn. The space is typically at least $\frac{1}{2}$ inch wider than the width of the billet being sheared.

As illustrated in FIG. 5, the blade is divided into three sections—a first cutting section 60, a second tapered wedge section 70, and a third upper section 80. The blade has a die side 90 and a container side 95. The die side has a first cutting surface 61 which is substantially perpendicular to the longitudinal axis X of the billet. The container side of the cutting section 60 has a first cutting surface 66 which is 35 degrees from the vertical axis Y. The cutting surfaces 61 and 66 of the preferred embodiment extend a maximum of 1 inch from the cutting edge 50 of the shear blade.

At the upper point of the cutting die side surface 61, the blade is tapered away from the die to a point approximately $\frac{1}{8}$ inch inwardly from the outer dimension of cutting surface 61 when measured from the die. This indented surface 63 of the die side of the shear blade eliminates the frictional forces caused by contact between the blade and the residual aluminum 40.

Figure 7:
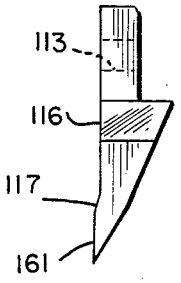
FIG. 7 is a side view of the shear blade without guide prongs.

As previously stated, the butt side 95 of the blade is provided with a first cutting surface 66 which is at an angle of 35 degrees from the vertical axis Y in a preferred embodiment. Thus, a wedge is formed between sides 66 and 61 as seen in FIG. 7. The second wedge portion 70 has a smaller included angle to reduce or prevent contact between the sheared butt end of the billet and the blade thereby reducing the frictional forces caused by contact between the sheared butt and the blade. This supplementary relief angle is approximately 26 degrees in a preferred embodiment. The supplementary relief angle assures that contact between the sheared butt and the blade will only occur at the cutting surfaces. In other embodiments, the angle formed between cutting surfaces 60 and 66 can be in the range of 25 to 45 degrees. In all embodiments, the included angle of the second tapered wedge portion 70 will be less than the included angle of the cutting section 60.

Figure 6:
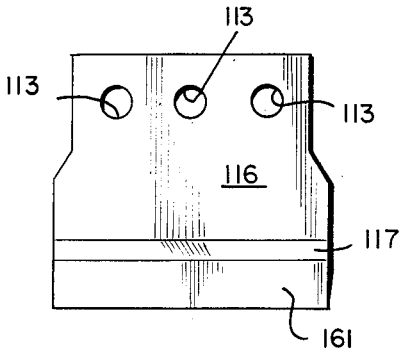
FIG. 6 is a rear view of the shear blade without guide prongs.

FIG. 6 shows a front view of the cutting blade without alignment prongs. The die side of the blade has edge 161 connected to edge 116 by tapered portion 117. The blade has holes 113 to bolt to a driving mechanism.

FIG. 7 is a side view of the blade without alignment prongs. This embodiment provides a peeling effect without smashing of the billets. These blades can be used in embodiments where alignment is ensured by other means.

Although the present invention has been described in detail, the same is by way of illustration and example only and is not to be taken by way of limitation. The spirit and scope of the present invention are to be limited only by the terms of the appended claims.

What is claimed is:

1. An improved shear blade for a butt shearing apparatus associated with guide means and operative force means for removing an unextruded butt end of a billet of metal adjacent a die ring in an extrusion press, comprising:

a cutting section;

a cutting edge;

a die ring side extending from said cutting edge;

a butt side of the blade extending upward from said cutting edge;

said cutting section including a first cutting section having a first included angle extending from said cutting edge for slicing said unextruded butt end of said billet from said billet adjacent said die ring; and said cutting section including a second wedge shaped section having a second included angle between said die side and said butt side which extends from said first cutting section and is less than said first included angle.

2. The shear blade of claim 1 wherein said first means includes a first wedge shaped portion of said cutting section having a first included angle of between 20 and 45 degrees between said die ring side and said butt side.

3. The shear blade of claim 2 wherein said first included angle is 35 degrees.

4. The shear blade of claim 2 wherein said die side is substantially perpendicular to the longitudinal axis of said unextruded butt end.

5. The shear blade of claim 3 wherein said cutting section has a maximum longitudinal length of 1 inch.

6. The shear blade of claim 1 wherein said second included angle is 26 degrees.

7. The shear blade of claim 1 wherein said die side includes second means for reducing friction between said shear blade and said unextruded butt end.

8. The shear blade of claim 7 wherein said second means includes an indented portion of said die ring side which indented portion is more distant from said die ring than is said die ring side.

9. An improved shear blade for a butt shearing apparatus associated with guide means and operative force means for removing an unextruded butt end of a billet of metal adjacent a die ring in an extrusion press, comprising:

a cutting section;

a cutting edge;

a die ring side extending from said cutting edge;

a butt side extending from said cutting edge;

said cutting section including first means for slicing said unextruded butt end of said billet from said billet adjacent said die ring;

alignment means for establishing a predetermined offset along the longitudinal axis of said billet between said cutting edge and said die ring.

10. The shear blade of claim 9 wherein said first means includes a first wedge shaped portion of said cutting section having a first included angle of between 20 and 45 degrees.

11. The shear blade of claim 10 wherein said alignment means are attached to said blade and extend away from said first wedge portion and beyond said cutting edge.

12. The shear blade of claim 11 wherein said alignment means include at least one cam means for cooperative engagement with said die ring.

13. The blade of claim 11 wherein said alignment means include two alignment prongs each having cam means for cooperative engagement with said die ring.

14. The shear blade of claim 10 wherein said shear blade includes a second wedge shaped section having a second included angle between said die side and said butt side which is less than said first included angle.

15. The shear blade of claim 9 wherein the first included angle is 35 degrees.

16. The shear blade of claim 9 wherein said die side is substantially perpendicular to the longitudinal axis of said unextruded butt end.

17. The shear blade of claim 9 wherein said cutting section has a maximum longitudinal length of 1 inch.

18. The shear blade of claim 9 wherein said die side includes second means for reducing friction between said shear blade and said unextruded butt end.

19. The shear blade of claim 18 wherein said second means includes an indented portion of said die ring side which indented portion is more distant from said die ring than is said die ring side.

20. The shear blade of claim 9 wherein said blade includes:

a first side portion;

a second side portion;

first and second side portions connected to said butt and said die ring side at opposing locations.

21. The shear blade of claim 20 wherein said alignment means are connected to said first and second side portions.

* * * * *